US007065924B2

(12) United States Patent
Wade

(10) Patent No.: US 7,065,924 B2
(45) Date of Patent: Jun. 27, 2006

(54) DOWNPIPE CONNECTOR SYSTEM

(76) Inventor: Rodney George Wade, 148 Wongawallen Dr., Upper Coomera, Queensland, 4210 (AU)

( * ) Notice: Subject to any disclaimer, the term of this patent is extended or adjusted under 35 U.S.C. 154(b) by 0 days.

(21) Appl. No.: 10/691,596

(22) Filed: Oct. 24, 2003

(65) Prior Publication Data

US 2005/0102927 A1 May 19, 2005

(51) Int. Cl.
*E02D 5/74* (2006.01)

(52) U.S. Cl. ..... 52/16; 52/302.1

(58) Field of Classification Search ..... 285/40, 285/42–44; 4/191, 286, 255; 52/302.1, 52/13–14, 16, 302.3, 232
See application file for complete search history.

(56) References Cited

U.S. PATENT DOCUMENTS 3,703,302 A * 11/1972 Demler, Sr. ..... 285/139.1
3,893,919 A * 7/1975 Flegel et al. ..... 210/166
4,306,738 A * 12/1981 Lindquist ..... 285/4
4,641,464 A * 2/1987 Andersson, et al. ..... 52/16
4,658,092 A * 4/1987 Nakamura et al. ..... 174/182
4,730,854 A * 3/1988 Cuschera ..... 285/42
4,739,524 A * 4/1988 Burd ..... 4/286
4,850,617 A * 7/1989 Moberly ..... 285/42
4,879,771 A * 11/1989 Piskula ..... 4/256.1
4,964,180 A * 10/1990 Harbeke ..... 4/288
5,297,817 A * 3/1994 Hodges ..... 285/15
5,299,836 A * 4/1994 Woods ..... 285/42
5,341,523 A * 8/1994 Barnes ..... 4/507
5,358,006 A * 10/1994 Sweers ..... 137/615
5,618,416 A * 4/1997 Haefner ..... 210/163
6,141,916 A * 11/2000 Shackelford ..... 52/12
6,185,885 B1 * 2/2001 Thaler ..... 52/219
6,185,889 B1 * 2/2001 Gilgan et al. ..... 52/302.1
6,405,502 B1 * 6/2002 Cornwall ..... 52/220.8
6,647,682 B1 * 11/2003 Bishop ..... 52/302.1

OTHER PUBLICATIONS www.cbsantafe.com/glossary.*
www.naturalhomesrealty.com/glossary.*

* cited by examiner

*Primary Examiner*—Peter M. Cuomo
*Assistant Examiner*—Erika Garrett
(74) *Attorney, Agent, or Firm*—Millen, White, Zelano & Branigan, P.C.

(57) ABSTRACT

A downpipe connector system is disclosed. The system having a downpipe connector for attachment to a channel in a canale. The connector has a first portion with an upstanding wall and a floor from which the floor extends. A tubular extension projects from the floor and having a flow passage extending therethrough the system has a transverse wall extending across the channel and downstream of the connector and extends upwardly in the channel from the upstanding wall.

9 Claims, 3 Drawing Sheets

DOWNPIPE CONNECTOR SYSTEM

BACKGROUND OF THE INVENTION

This invention relates to a downpipe connector system.

In many countries and especially in Mexico and the southern parts of the United States of America, homes and other buildings are sometimes constructed with flat composite and gravel roofs. This style of roof is sometimes called a Santa Fe style.

Rainwater from these flat roofs of Santa Fe style houses is conveyed to the ground via canales. In older style buildings, logs project outwardly from outside walls of the building and have the appearance as being part of the support structure of the building. They are in fact short lengths of tree logs and have a channel formed in an upwardly facing part of the log and extend along the log to form a crude gutter along which water from the roof may be conveyed. These logs are fitted flush with the inside of the parapet wall with the top of the canales flush or slightly lower than the flat roof surface.

Rain which falls onto the roof is directed from the flat roof to the canales and flows along the channels formed in the canales and is directed away from the building and falls onto the ground. In this way, water is able to drain from the roof and falls onto the ground and away from the foundations of the building.

New Santa Fe style homes are now no longer made from mud brick but are constructed of timber and stucco to give the building the appearance of a traditional Santa Fe style. Canales are typically constructed from straight sawn timber with a channel lined with aluminium and have a flat base of a width of about 8 inches (200 m). Once again rainwater, when it exits the canale, normally drops onto the ground. The ground may be prepared for better drainage with aggregate or aggregate placed over a grided drain.

There is now a need to harvest water from roofs of this type and this was not previously possible.

OBJECT OF THE INVENTION

It is an object of the present invention to provide a downpipe connector system which allows water from diverted canales to be collected and directed to a downpipe for harvesting.

SUMMARY OF THE INVENTION

According to one aspect, the invention provides a downpipe connector system having a downpipe connector for attachment relative to a channel in a canale, the connector having a first portion with an upstanding wall and a floor from which the wall extends, a tubular extension projecting from the floor and having a flow passage extending therethrough, and the system further having a transverse wall extending across the channel and downstream of the connector and extending upwardly in the channel from the upstanding wall.

DESCRIPTION OF THE INVENTION

Preferably, the tubular extension is substantially circular in transverse cross section and in which case the upstanding wall is substantially circular in shape when viewed from above. In this embodiment, the floor is substantially annular in shape. The tubular extension, floor and wall may have any other suitable shape.

The tubular extension may terminate in a merging section.

A second tubular extension of a transverse area smaller than the transverse area of the first tubular extension may extend from merging section. The longitudinal central axis of the second tubular extension is offset relative to the longitudinal central axis of the second section. Preferably both sections have a circular transverse shape.

In the system of the invention the transverse wall extends down into the channel and terminates at a height corresponding to the height of the upstanding wall. Since the wall extends across the full width of the channel a respective low flow and sediment flow passage is present in the channel on sides of the upstanding wall. Where the wall is circular in shape, the flow passages are located at diametrically opposed locations relative to the wall.

DESCRIPTION OF THE DRAWINGS

A particular preferred embodiment of the invention will now be described by way of example with reference to the drawings in which.

DESCRIPTION OF PREFERRED EMBODIMENT

Figure 1:
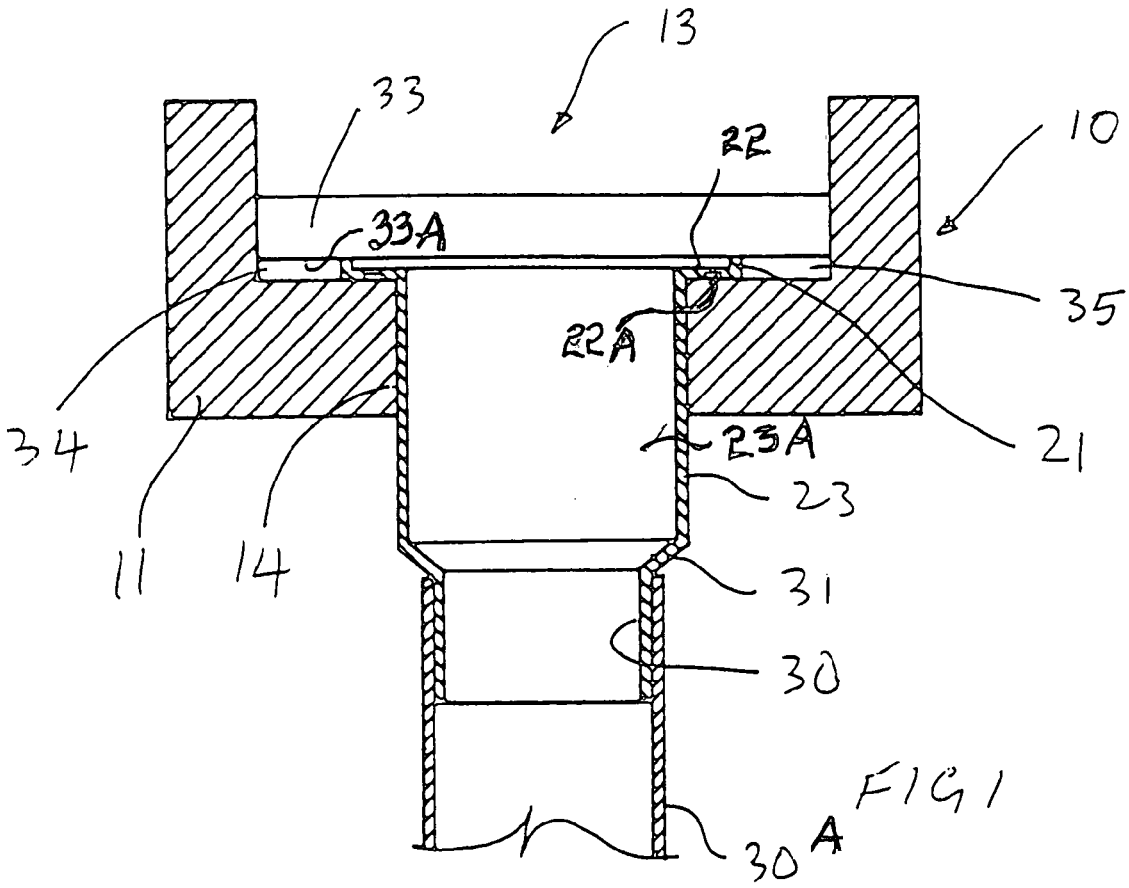
FIG. 1 is a transverse sectional view taken through a canale and showing detail of a downpipe connector system according to an embodiment of the invention.
Figure 2:
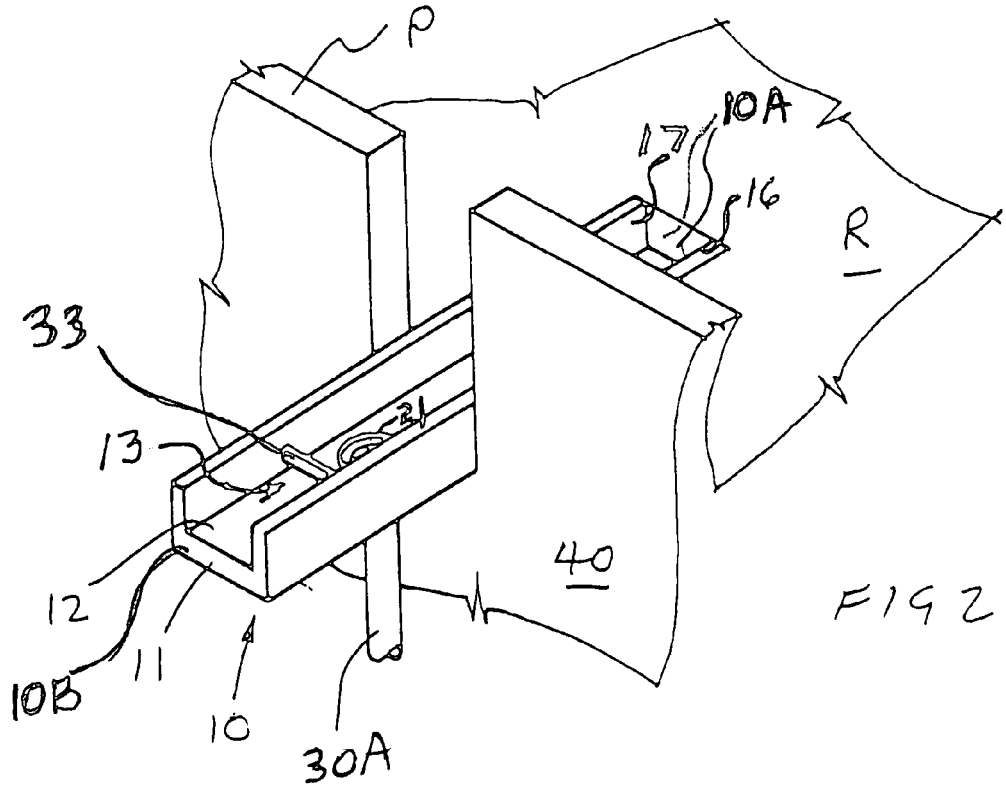
FIG. 2 is a top perspective view of a downpipe connector system according to an embodiment of the invention.
Figure 3:
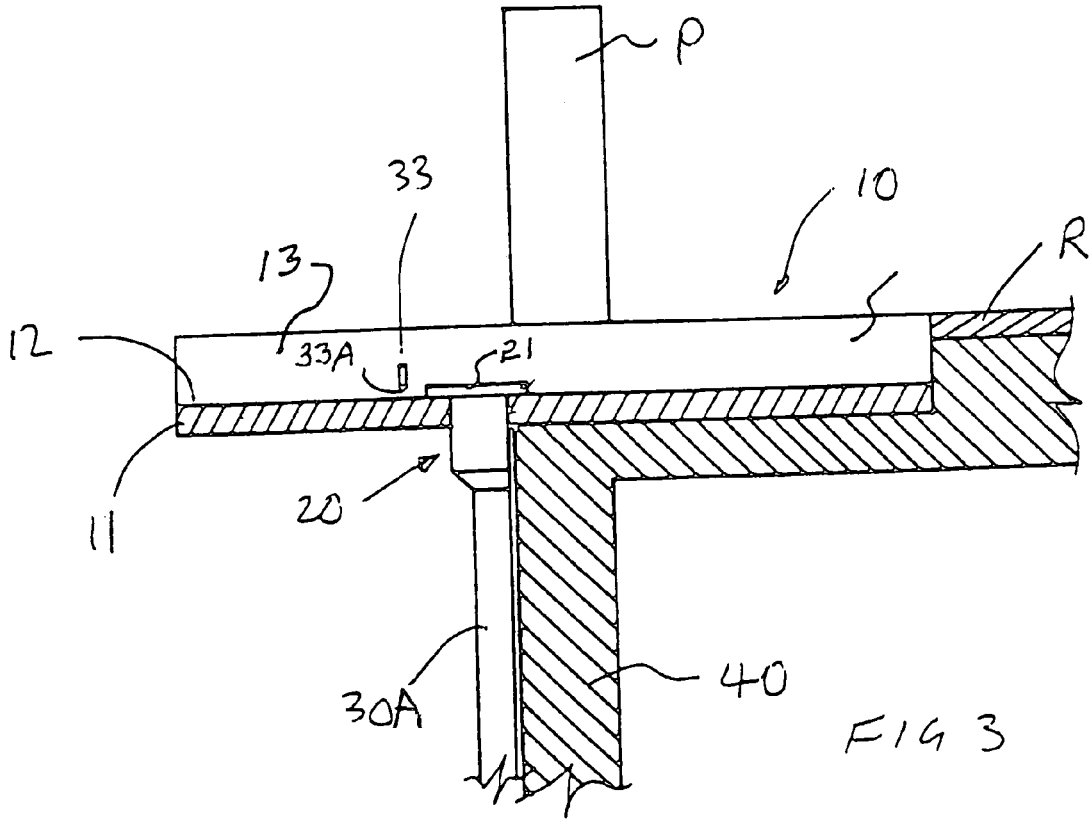
FIG. 3 is a longitudinal sectional view of the system as shown in FIG. 5.

As shown in FIG. 2, the canale 10 has a base 11 with a base wall 12. A rectangular channel 13 is formed in the canale 10. A circular passage 14 (see FIG. 1) is formed in the canale 10 and extends from the channel 13 (see FIG. 1) and through the base 11. The canale 10 projects through a parapet P of a building having a roof R. The top of the canale 10 is shown flush with the upper surface of the roof wit the canale having a first end 10A within the roof R and a second end 10B extending past the parapet P.

Figure 4:
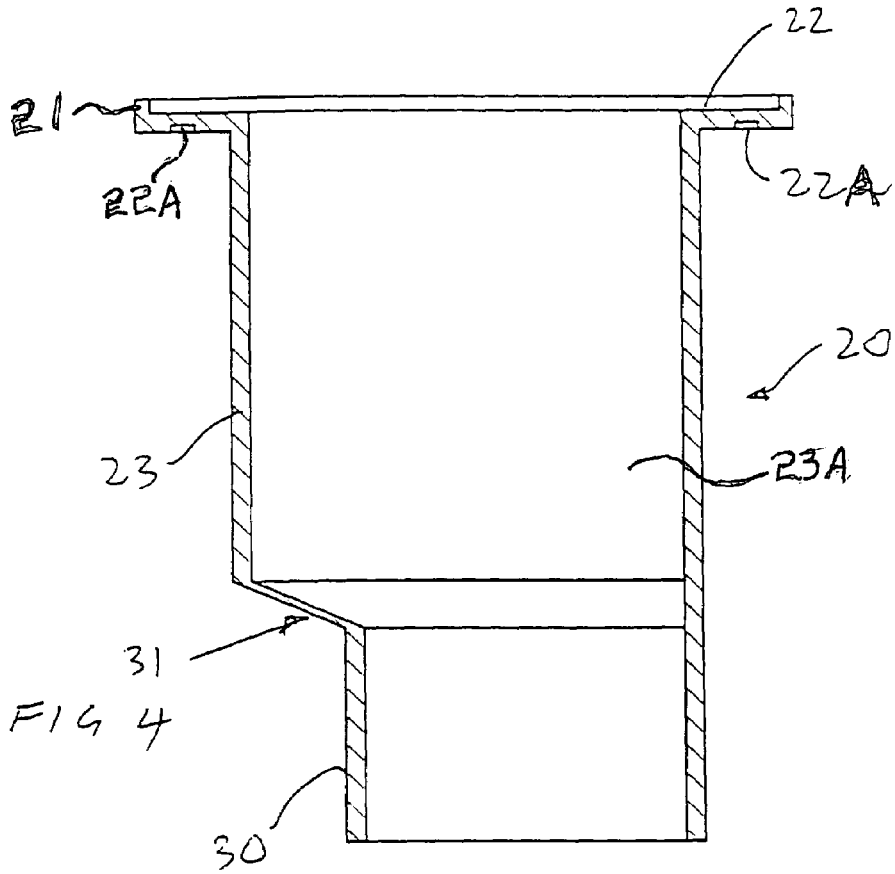
FIG. 4 is a vertical sectional view of a downpipe connector of the system shown in FIGS. 1 to 3.
Figure 5:
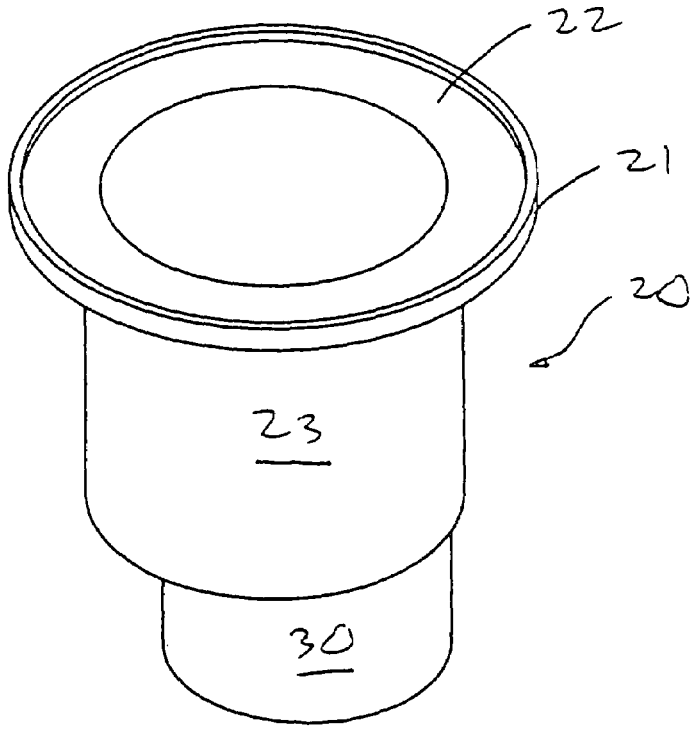
FIG. 5 is a top perspective view of the downpipe connector of FIG. 4.

As shown in FIGS. 4 and 5, connector 20 has a first portion with an upstanding circular wall 21 and a floor 22. The underside 22A of the floor 22 rests on the base wall 12 of the channel 13 and extends around the passage 14. The underside is provided with a groove 22*a* for receiving a sealant.

A first tubular extension 23 of first diameter corresponding to the diameter of the passage 14 extends from the floor 22 and projects beyond the base wall 12 of the canale for providing a higher flow fluid passage 23A.

The connector 20 in this embodiment has a second tubular extension 30 of a diameter less than the diameter of extension 23. A merging section 31 extends between extension 23 and extension 30. Typically, extension 23 has a diameter which allows it to fit neatly within a 4 inch diameter downpipe 30A whilst extension 30 has a diameter which allows it to fit neatly within a 3 inch diameter downpipe 30A. Where the system is used in a situation having 4 inch diameter downpipes, merging section 31 and extension 30 may be omitted.

Merging section 31 may have a length of about 0.5 inches, extension 23 may have a length of about 4 inches and extension 30 may have a length of about 2 inches although other lengths and diameters are not excluded.

As shown in FIG. 1 a transverse wall 33 with a bottom edge 33A extends across the channel 13 and at a location downstream of the first portion of the connector. The wall 33 acts as a weir or dam and extends from a location in the channel adjacent the upper end of wall 21. Low flow and sediment flow passages 34, 35 remain in the channel 13 and on either side of the channel adjacent the wall 21.

FIG. 2 shows a top perspective view of the system of an embodiment of the invention. The extensions 23 and 30 are not concentrically aligned. In this way, when extension 30 is present and locates within a downpipe 30*a*, the downpipe may extend closely adjacent and along and down an external wall 40 of a building to which the system of the invention is fitted. Likewise, with extension 30 and merging section 31 omitted, the downpipe fitted to extension 23 is also able to extend neatly closely adjacent and along and down the wall of the building.

The system of the invention allows downpipes to be coupled to the canales and thus rainwater from the roof of the building may be collected and stored for later use.

In order to fit the connector to a canale, passage 14 is formed in the canale. Sealant 40 in a groove in the underside of floor 22 seals the connector to the channel 13 in the canale.

When light rain falls on the roof of a building having canales like canale 10, the wall 21 ensures that the water does not flow through the connector 20 but rather flows under the wall 33 and through the sediment flow passages 34, 35. In this way initial light rain which is likely to contain sediment is not caused to flow through the connector 20. Heavier flow may pass over wall 21 and through the connector and this is assisted by the wall 33.

In the case of heavy rain, extreme flows of water may pass over wall 33 and flow along the channel 13 and onto the ground when the connector is unable to cope with heavy flows.

I claim:

1. A downpipe connector system having a canale and a downpipe connector for attachment the canale of a building, the canale having therein a channel with a base and side walls and a first end in the roof and second end outboard of the roof, the connector passing through the base of the channel of the canale and having a first portion with an upstanding wall and a floor from which the upstanding wall extends, a first tubular extension projecting from the floor and having a first flow passage extending therethrough for higher flow drainage collection; the system further having a transverse wall with a bottom edge extending across the channel in the canale and positioned downstream of the connector, the transverse wall extending upwardly in the channel with respect to the upstanding wall of the connector with second flow passages located at sides of the upstanding wall and between the bottom edge of the transverse wall and the base of the channel for low flow and sediment flow drainage along the canale.

2. The connector system of claim 1 wherein the tubular extension has a circular transverse cross sectional shape.

3. The connector of claim 1 wherein the tubular extension terminates in a merging section and a second tubular extension extends from the merging section.

4. The connector system of claim 3 wherein the first and the second tubular extensions have a circular transverse cross sectional shape.

5. The connector system of claim 4 wherein a central longitudinally extending axis through the first extension is offset relative to a central longitudinally extending axis through the second extension.

6. The connector system of claim 4 wherein the first tubular extension has a length of about 4 inches.

7. The connector system of claim 4 wherein the second tubular extension has a length of about 2 inches.

8. The connector system of claim 1 wherein the side walls of the channel extend downwardly with respect to a surface defined by a roof in which the canale is installed.

9. The connector system of claim 1 wherein the downpipe connector is disposed at a position in the canale which is outboard of a parapet of the building.

* * * * *